US005481108A

United States Patent [19]

Yano et al.

[11] Patent Number: 5,481,108

[45] Date of Patent: Jan. 2, 1996

[54] METHOD FOR ION DETECTION AND MASS SPECTROMETRY AND APPARATUS THEREOF

[75] Inventors: Masayoshi Yano, Hitachinaka; Kohei Mochizuki, Tokyo, both of Japan

[73] Assignee: Hitachi, Ltd., Tokyo, Japan

[21] Appl. No.: 351,155

[22] Filed: Nov. 30, 1994

[30] Foreign Application Priority Data

Dec. 28, 1993 [JP] Japan ..... 5-334911

[51] Int. Cl.[6] ..... H01J 43/02

[52] U.S. Cl. ..... 250/283; 250/281; 250/282; 250/397

[58] Field of Search ..... 250/283, 281, 250/282, 397

[56] References Cited

FOREIGN PATENT DOCUMENTS 60-89787 5/1985 Japan ..... 250/397

*Primary Examiner*—Jack I. Berman
*Attorney, Agent, or Firm*—Kenyon & Kenyon

[57] ABSTRACT

Object

To improve detecting sensitivity of negative ions.

Construction

A mass-filtered negative ion beam 22 is irradiated on a plate 24 after passing through a slit to emit neutral atoms 27, the neutral atoms 27 being ionized by an electron flow 33 after passing through a mesh electrode 30, the ion beam 35 ionized entering to a secondary electron multiplier to be amplified, then the amplified current entering to an amplifier 37 to be further amplified.

Effects

The detecting sensitivity can be improved more than ten times owing to the difference in existing amount of sputtering yield between neutral atoms and secondary ions.

30 Claims, 6 Drawing Sheets

1
2
3
4
5
6
7
8
9
10
11
12
13
14
15
16
17
18
FAN
PUMP
PUMP

METHOD FOR ION DETECTION AND MASS SPECTROMETRY AND APPARATUS THEREOF

BACKGROUND OF THE INVENTION

1. Field of the Invention

The present invention relates to a method for ion detection and mass spectrometry and an apparatus thereof.

2. Description of the Related Art

In general speaking, various kinds of apparatuses generating ions are widely used, a mass spectrometer, for example, is one of them. In a mass spectrometer, a specimen is ionized and the ions (ionized specimen) are classified according to the masses, and the masses are analyzed by detecting the ions. In the apparatus generating ions, positive ions are generated or negative ions are generated depending on the chemical property of the specimen and the ionizing condition when ions are generated. Therefore, it has been required to detect both of the positive ions and the negative ions.

However, an apparatus detecting negative ions has been of inferior performance or of high cost comparing to an apparatus detecting positive ions due to a lot of limitations in construction. To solve such a problem, there has been proposed a technique where negative ions are hit onto a solid surface to generate positive ions and detect the positive ions, which is a technique to detect negative ions in the result. Such a technique is described, for example, in Japanese Patent Publication No.58-7229 (1983).

In an apparatus where negative ions are hit onto a solid surface to secondarily generate positive ions, the amount of the generated positive ions is, however, approximately a tenth to a hundredth of the amount of the hit negative ions. In the conventional technique, the detected signals are covered with noise due to inferiority of the conversion efficiency of negative ions as described above and there arises a problem in that sufficient detecting accuracy cannot be obtained.

SUMMARY OF THE INVENTION

An object of the present invention is to detect negative ions with a high accuracy.

In order to attain the above object, according to the present invention, negative ions are converted into neutral particles and the neutral particles are detected.

Generally, the generating rate of neutral particles from negative ions is comparatively high. Since detection of negative ions in accordance with the present invention utilizes particles having such a high generating rate and consequently the detection level is improved, it is possible to detect negative ions with a high accuracy.

DETAILED DESCRIPTION OF THE PREFERRED EMBODIMENTS

Figure 1:
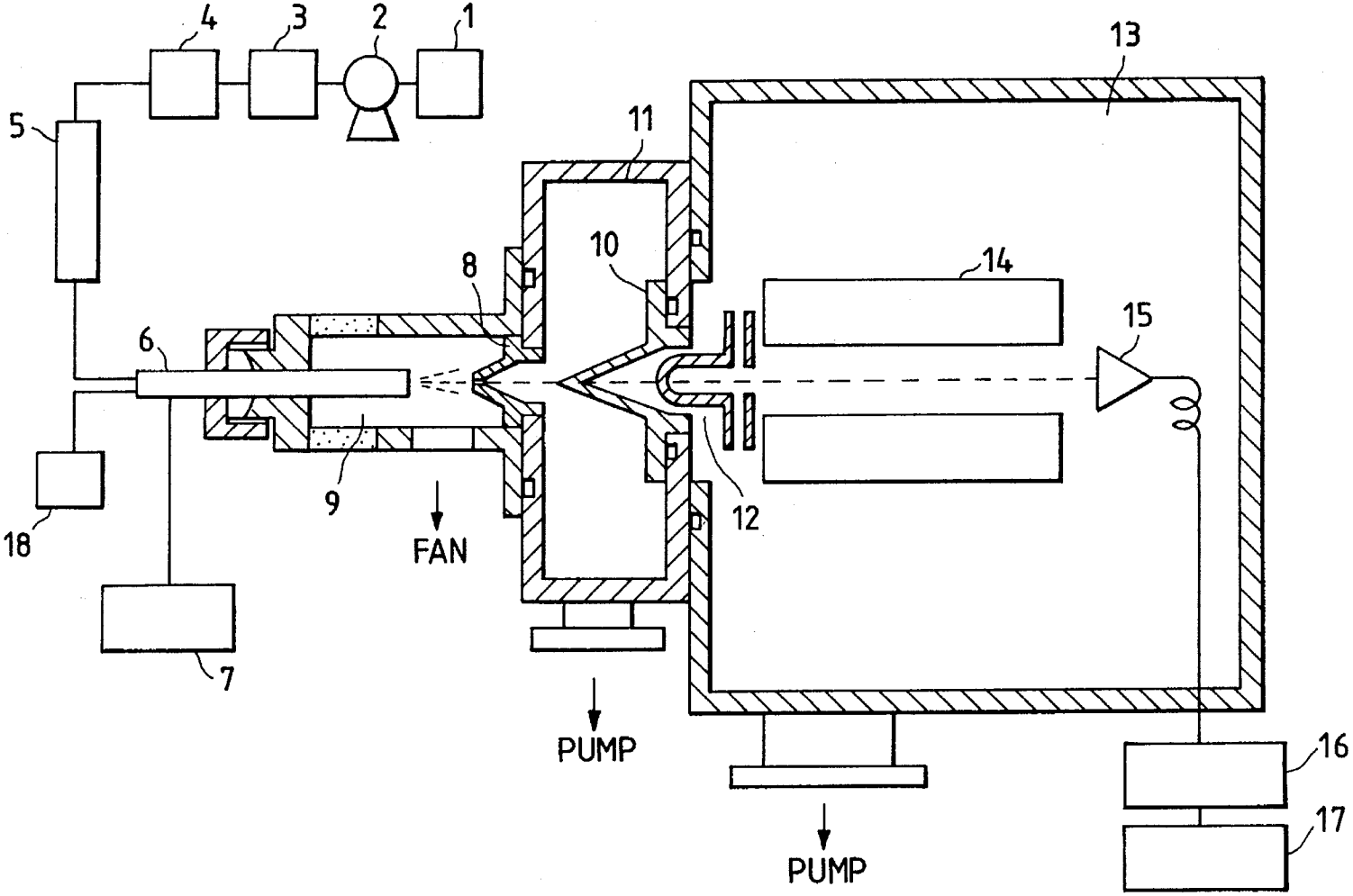
FIG. 1 is a general view of an apparatus.

The present invention will be described in detail below, referring to the accompanying drawings. FIG. 1 is a general view of a mass spectrometer of liquid chromatography combined type. Eluant contained in an eluant container 1 is pumped by a pump 2, the pulsating flow is suppressed by a damper 3 and then the eluant flows in from a specimen injection port 4. A specimen is injected to the specimen injection port 4 and mixed with the eluant. The mixed liquid is separated while passing through a column 5 and then supplied to a double tube 6 (electric conductive material). The double tube 6 is of two-fold tube structure. A gas from a gas supply 18 is supplied to the outer tube and the liquid from the column 5 is supplied to the inner tube, and each of the flows is discharged into an ionization chamber 9 (maintained at atmospheric pressure) from the front end portion of the double tube 6. An electric field is applied between the double tube 6 and a first perforated electrode 8 to ionize the discharged liquid particles under the atmospheric pressure with electrospray phenomenon. The ionized discharged liquid particles are accelerated with an electric field between the first perforated electrode 8 and a second perforated electrode 10. The ionized specimen discharges the eluant in this process, and then led to a second vacuum chamber 13 with a electric field between the second perforated electrode 10 and an extracting electrode 12. The second vacuum chamber is kept at a high vacuum by a pump.

Figure 3:
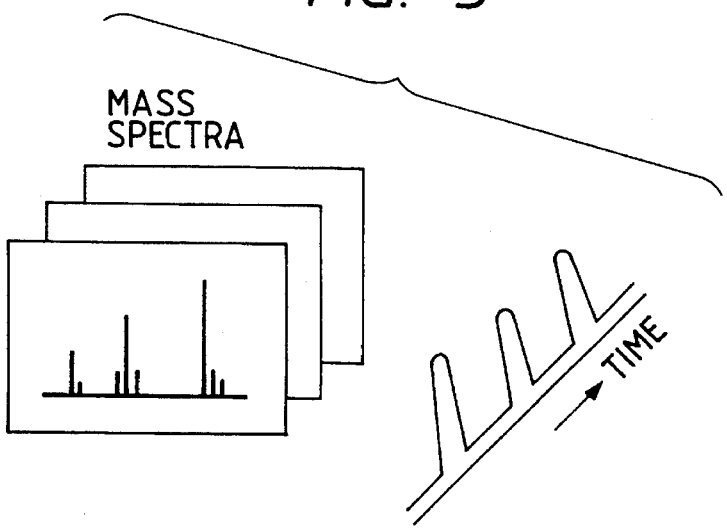
FIG. 3 is a view showing mass spectra.

A mass filter 14 is of variable electric field type and lets ions only having a given mass corresponding to the strength of the electric field pass. The ionized specimen is detected (converted to current) with an ion detector 15 after passing thorough the mass filter 14, the current being amplified with an amplifier 16 and led to a data processor 17. The data processor 17 stores information with regard to the results of mass spectrometry of the specimen and mass spectra such as FIG. 3 are displayed in a display.

Figure 2:
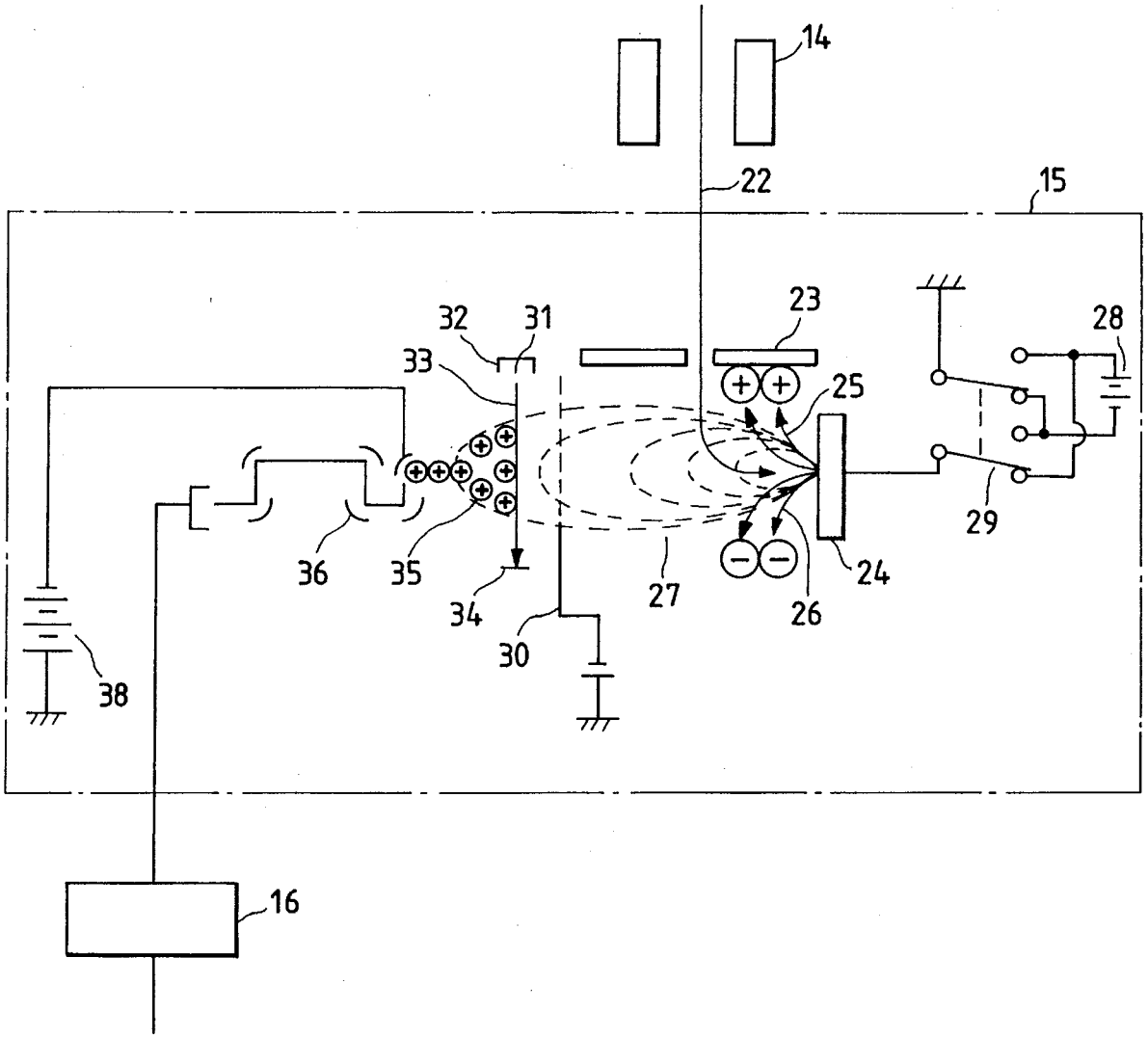
FIG. 2 is a view showing a detail of detecting ions.

FIG. 2 shows a detail of an ion detector 15. Ion detection, mainly, negative ion detection will be described in connection with the ion detector 15. An ion beam 22 having a given mass separated by the mass filter 14 is led to a slit 23. Voltage is applied between the slit 23 and a plate 24 with a high voltage supplied from a high voltage supply 28 through a selecting switch 29. Each ions in the ion beam 22 is accelerated by the electric field produced by the high voltage, being converged with the slit 23 and then collides against the plate 24. Therein, the direction of the electric field between the slit 23 and the plate 24 can be changed by turning the electing switch 29. When the ion beam 22 collides against the plate 24 applied with a high positive voltage (it is possible to apply a high negative voltage by turning the selecting switch 29), a collision cascade phenomenon occurs to emit positive ions 25, negative ions 26 and neutral atoms 27 from the plate 24. Therein, electrons and photons, not shown, are also emitted in accompanying with the particles (refer to FIG. 5). A negative voltage is applied to a mesh electrode 30. Under this state, the charged particles such as the positive and negative ions 25, 26 and the electrons are affected with forces determined by the electric potential relations of the slit 23, the plate 24 and the mesh electrode 30 applied with a negative voltage, and collide against each of the parts and the vacuum wall (not shown) to lose the charge. Therefore, the charged particles cannot pass through the mesh electrode 30. On the other hand, the neutral atoms 27 pass through the mesh electrode 30.

Electrons generated by heating an electron source 31 form an electron flow 33 which is emitted toward a target 34 by the electric field formed from a repeller 32 having a higher electric potential than that of the electron source 31 to the target 34. Thereby, the neutral atoms 27 passed through the mesh electrode 30 collide with the electron flow 33 to be ionized and become positive ion particles (ion beam) 35. The ion beam 35 is launched into the first stage dynode of a secondary electron multiplier 36 applied with a negative high voltage. Then, the ion beam 35 is converted into a current value (detected) to transmitted to an amplifier 16.

The ionization of the neutral atoms 27 (conversion to positive ions) will be described in detail below, referring to FIG. 4. The electron source 31 comprises a filament 40 and a power source 42. By applying voltage to the filament 40, the electrons (thermal electrons) 33 are emitted from the filament. The top of the filament 40 is projected farther toward the target 34 than the repeller 32 (having a grid-shape). The filament 42 is grounded. The repeller 32 is grounded through a first variable voltage power source 43, the electric potential of the repeller 32 is positive and controllable by use of the first variable voltage power source 43. The mesh electrode 30 is electrically connected to the repeller 32. The target 34 is grounded through the first variable voltage power source 43 and a second variable voltage power source 44, the electric potential (positive potential) of the target 34 is kept higher than the electric potential of the repeller 32 and is controllable by the first variable voltage power source 43 and the secondary variable voltage power source 44. The secondary electron multiplier 36 is grounded through an electric power source 45 (for example, −3 kV) and kept at a negative electric potential.

As described above, the potential difference between the filament 40 and the repeller 32 and the potential difference between the repeller 32 and the target 34 are controllable so that the neutral atoms 27 may be properly ionized (positively ionized).

When ions are irradiated on a solid surface with a high electric potential (several 10 keV), collision cascade generally occurs to emit the solid atoms from the solid surface through two kinds of collision processes, elastic collision and non-elastic collision between the incident ions and the atoms composing the solid. This phenomenon is called as sputtering. The quantity of sputtering yield defined by average number of emitted solid atoms per one incident ion is expressed by Equation 1.

$$Y = 0.042\,\frac{\alpha\,(M_2/M_1) \times Sn\,(E)}{U_s} \qquad \text{(Equation 1)}$$

There, $\alpha(M_2/M_1)$ is a constant determined by the mass ratio of solid atom and incident ion, $U_s$ is surface bond energy (indicating the bonding strength of atoms on the solid surface), Sn(E) is nucleus stopping cross section in the vicinity of the surface. The sputtering yield defined by Equation 1 is approximately $10^{-1}$ to 10 atoms/ion. Although the most part of the sputtering yield is of neutral atoms, a part ($10^{-2}$ to 10%) is of ions having positive and negative polarities.

Figure 5:
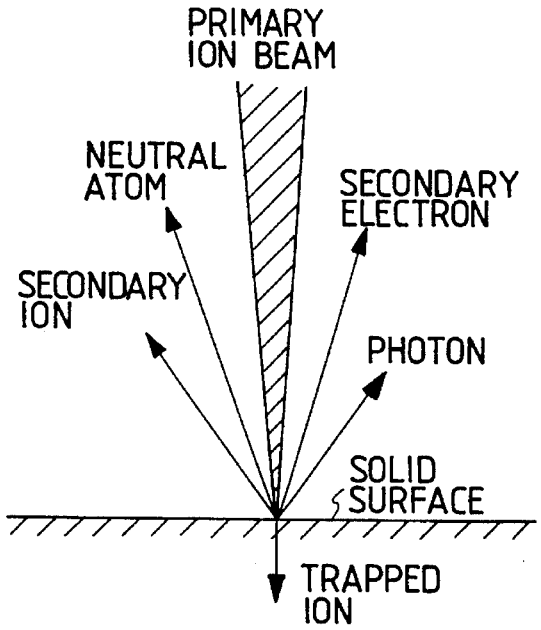
FIG. 5 is a view explaining a phenomenon where an ion beam hits on a solid surface.

On the other hand, photons (infrared rays, visible rays, ultra-violet rays and X-rays) and electrons are emitted. FIG. 5 shows the feature of the particles generated by such ion bombardment.

As has been described, in the embodiment, the neutral atoms yielded overwhelmingly larger number comparing to the other particles are utilized to measure the amount of the incident ions.

The negative ions 22 mass filtered can be detected as the quantity proportional to the existing amount of the negative ions 22 from the neutral atoms existing 10 to $10^3$ times as many number as the spattered positive and negative ions.

In the result, the sensitivity is improved at least by more than 10 times estimated from the difference in existing amounts in sputtering yield between neutral atoms and secondary ions. Further, since the incident ions to the secondary electron multiplier are always stable positive ions ionized by the electron bombardment and the applied voltage to the secondary electron multiplier may be constant and, therefore, the multiplication factor of the multiplier is constant, the accuracy of quantitative measurement is improved by improvement in stability, reproducibility and the like.

Figure 4:
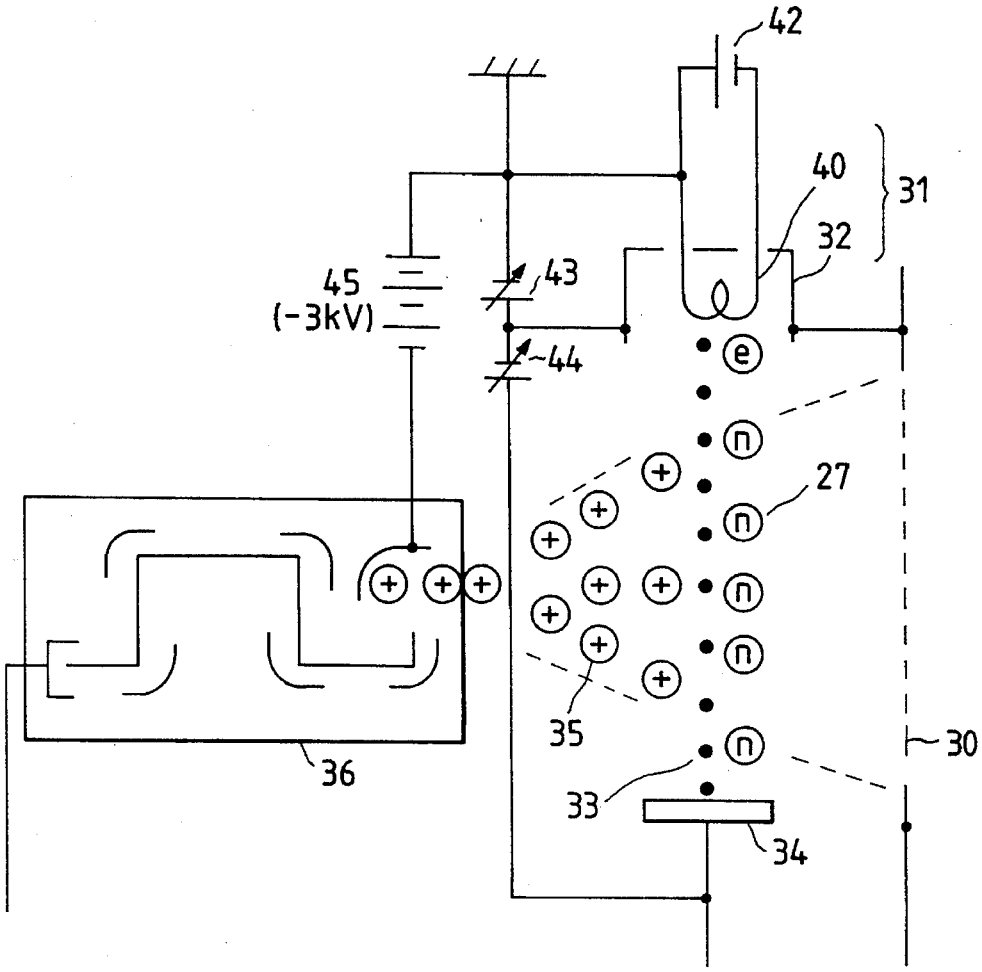
FIG. 4 is a view showing a detail of ionizing neutral atoms.

Further, by providing a plurality of ionizing means composed of an electron source 31, a repeller 32, an electron flow 33 and a target 34 in proper directions including in the direction intersecting in right angle with the direction shown in FIG. 4, the probability in ionization is further improved and the sensitivity can be improved.

Figure 6:
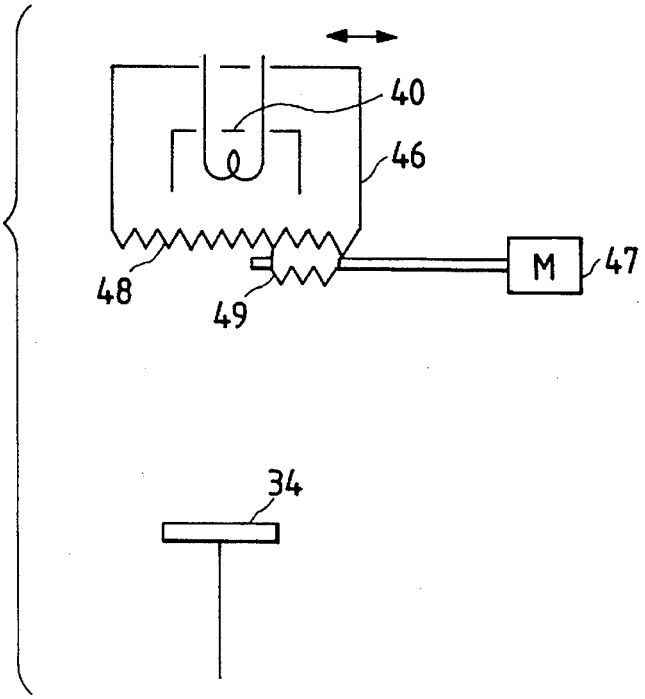
FIG. 6 is a view showing a second embodiment.

FIG. 6 shows a second embodiment. Only different points from the above embodiment will be described below, description on the other parts is omitted since they are the same as in the aforementioned embodiment (descriptions on the other following embodiment are dealt in the same manner).

In the second embodiment, the filament 40 is fixed to a moving table 46. The moving table 46 is mechanically connected to a motor 47 through a gear 48 provided on the moving table 46 and a gear 49 provided on the driving shaft of the motor 47. By driving the motor 47, the moving table 46 is moved. By doing so, relative position of the filament 40 against the target 34 is adjusted. That is, the flow of the electron beam 33 is controlled by moving the filament so that the neutral atoms 27 may be most efficiently converted to positive ions.

Figure 7:
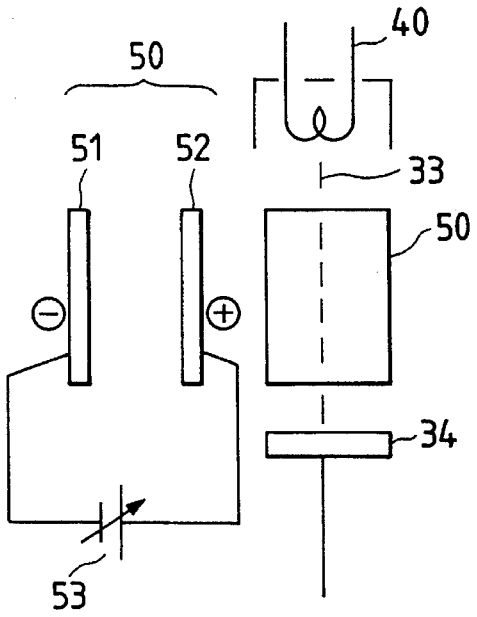
FIG. 7 is a view showing a third embodiment.

FIG. 7 shows a third embodiment. In the third embodiment, an electrode plate 51 and electrode plate 52 (they are generally referred to as "a pair of electrode plates 50") are placed between the filament 40 and the target 34 such as to sandwiching the electron beam 33. Voltage is applied to the electrode plate 51 and the electrode plate 52 from a variable voltage power source 53 and the voltage is controllable.

In the third embodiment, by controlling the voltage from the variable voltage power source 53, the flow of the electron beam 33 is controlled so that the neutral atoms 27 may be most efficiently converted to positive ions.

Figure 8:
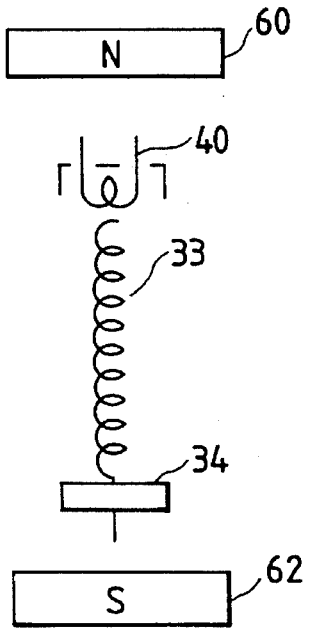
FIG. 8 is a view showing a fourth embodiment.

FIG. 8 shows a fourth embodiment. In the fourth embodiment, a positive pole of magnet 61 and a negative pole of magnet 62 are provided outside the filament 40 and the target 34 to form a magnetic field between them. The electron beam 33 moves from the filament 40 to the target 34 while being rotated by the effect of the magnetic field. By doing so, the collision probability of the electron beam 33 with the neutral atoms increases so that the conversion efficiency from the neutral atoms 27 to positive ions can be further improved.

Figure 9:
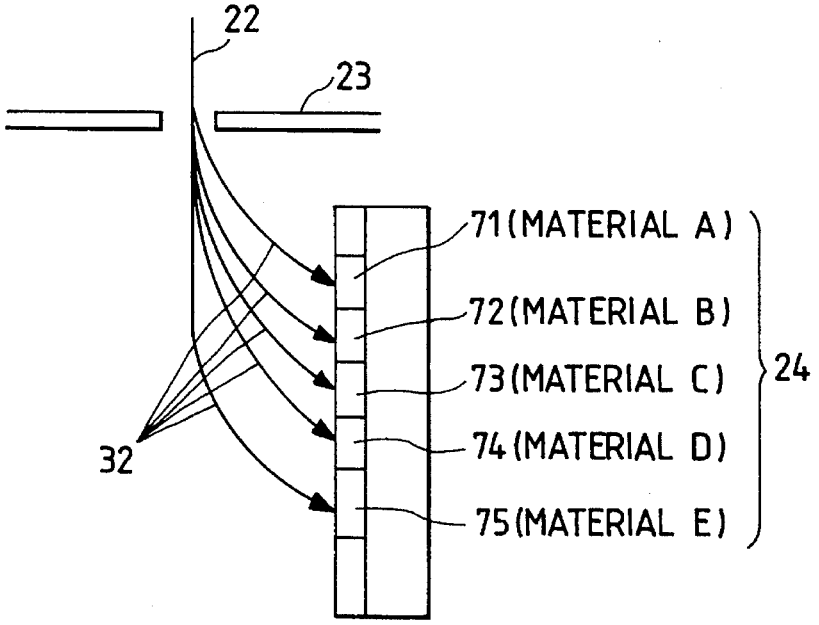
FIG. 9 is a view showing a fifth embodiment.

FIG. 9 shows a fifth embodiment. In the fifth embodiment, the plate 24 is composed of sub-plates made of different materials each, sub-plate 1 (material A) 71, sub-plate 2 (material B) 72, sub-plate 3 (material C) 73, sub-plate 4 (material D) 74, sub-plate 5 (material E) 75. The electric field between a slit 23 and the plate 24 is variable which is not shown in the figure, and then the in beam 22 can be selectively collided against any one of the sub-plate 1 (71) to the sub-plate 5 (75).

In the fifth embodiment, most proper plate material (material A to material E) can be selected depending on the physical property of the ion beam. Therefore, the ion beam 22 can be efficiently converted to the neutral atoms 27.

Figure 10:
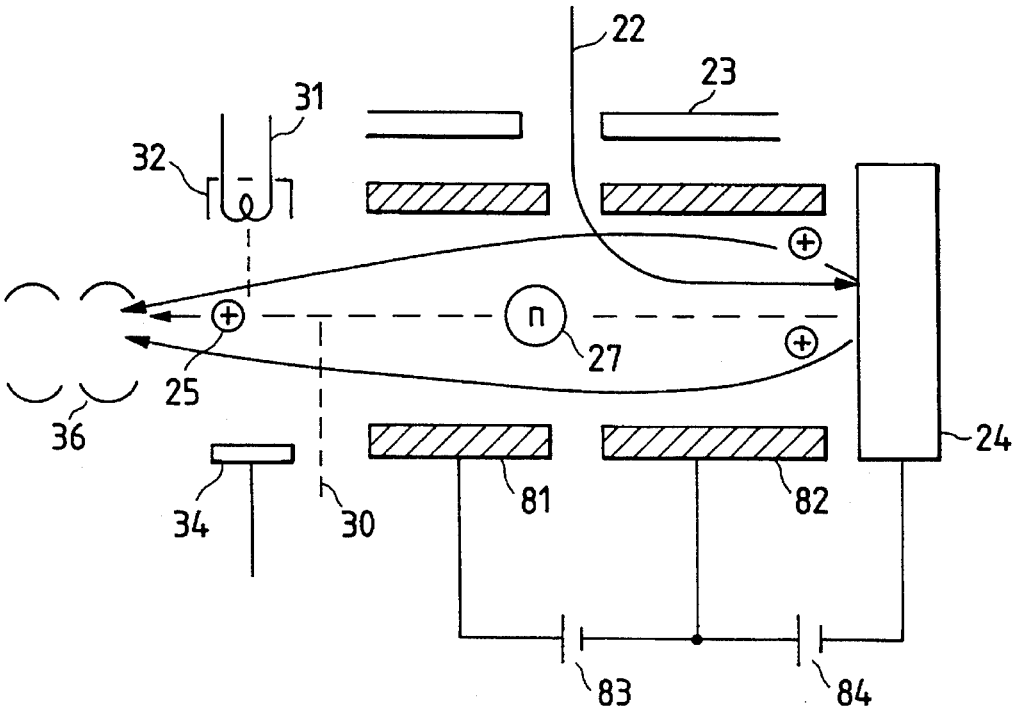
FIG. 10 is a view showing a sixth embodiment.

FIG. 10 shows a sixth embodiment. In the sixth embodiment, a lens electrode 81 and a lens electrode 82 are provided between the plate 24 and the mesh electrode 30. Voltages are supplied to the lens electrode 81 and the lens electrode 82 from a power source 83 and a power source 84, respectively, and the electric potentials are adjusted as to increase in order of the plate 24, the lens electrode 81, the lens electrode 82. By constructing in such a manner, the neutral atoms 27 generated in the plate 24 are efficiently led to the secondary electron multiplier 36. Therefore, the detecting accuracy can be improved.

In the aforementioned embodiments, in order to select most proper method having high ionizing efficiency according to materials, it is possible to employ a construction capable of selecting electron bombardment method, laser irradiation method, photo-ionization method or the like. The apparatus may be further simplified by eliminating the ionizing means and directly introducing the neutral particles into the first stage dynode the secondary electron multiplier to generate secondary electrons by sputtering.

As has been described, it is possible to detect negative ions with high accuracy.

What is claimed is:

1. A method for ion detection, comprising the steps of:

converting negative ions to neutral particles by sputtering; and detecting a signal corresponding to said neutral particles.

2. A method for ion detection, comprising the steps of:

converting negative ions to neutral particles;

converting said neutral particles to positive ions; and detecting said positive ions.

3. A method for ion detection according to claim 2, wherein:

said negative ions are collided against a solid surface to generate said neutral particles.

4. A method for ion detection according to claim 3, wherein:

charged particles are eliminated during the period between converting said negative ions to said neutral particles and converting said neutral particles to said positive ions.

5. A method for ion detection according to claim 3, wherein:

said negative ions are converged with a slit and then directed to said solid surface.

6. A method for ion detection according to claim 5, wherein:

an electric field is formed between said slit and said solid surface.

7. A method for ion detection according to claim 2, wherein:

said neutral particles are converted to said positive ions by generating electrons at an electron source and colliding said electrons with said neutral particles.

8. A method for ion detection according to claim 7, wherein:

said collision is performed by accelerating said electrons by an electric field.

9. A method for ion detection according to claim 8, wherein:

the strength of said electric field is controllable.

10. A method for ion detection according to claim 7, wherein:

the position generating said electrons is movable.

11. A method for ion detection according to claim 8, wherein:

a second electric field to deflect said electrons is formed.

12. A method for ion detection according to claim 8, wherein:

a magnetic field is formed and is superimposed on said electric field.

13. A method for ion detection according to claim 3, wherein:

said solid surface is formed of a plurality of materials, and the path of said negative ions is controlled such that said negative ions are selectively collided against any one of said plurality of materials.

14. A method for ion detection according to claim 2, wherein: said positive ions pass through a lens electrode.

15. A method for mass spectrometry, comprising the steps of:

ionizing a specimen into negative ions;

converting said negative ions to neutral particles by sputtering; and detecting a signal corresponding to said neutral particles.

16. A method for mass spectrometry, comprising the steps of:

ionizing a specimen into negative ions;

converting said negative ions to neutral particles;

converting said neutral particles to positive ions; and detecting said positive ions.

17. An apparatus for ion detection, comprising:

a converter for converting negative ions to neutral particles by sputtering; and a detector for detecting a signal corresponding to said neutral particles.

18. An apparatus for ion detection, comprising:

a first converter for converting negative ions to neutral particles;

a second converter for converting said neutral particles to positive ions; and a detector for detecting said positive ions.

19. An apparatus for ion detection, comprising:

a plate having an ion detecting part a switch coupled to apply a negative high voltage to said ion detecting part when detecting positive ions and to apply a positive high voltage to said ion detecting part when detecting negative ions;

an electron flow generating unit for generating an electron flow for ionization having a mesh electrode facing against the collision surface of said ions in said plate applied with a negative voltage behind said mesh electrode; and an ion amplifier in the rear stage of aid electron flow generating unit.

20. An apparatus for mass spectrometry, comprising:

an ionizing unit for ionizing a specimen into negative ions;

a converter for converting said negative ions to neutral particles by sputtering; and a detector for detecting a signal corresponding to said neutral particles.

21. An apparatus for mass spectrometry, comprising:

an ionizing unit for ionizing a specimen into negative ions;

a first converter for converting said negative ions to neutral particles;

a second converter for converting said neutral particles to positive ions; and a detector for detecting said positive ions.

22. Apparatus according to claim 21, wherein:

said second converter includes a source generating electrons and an accelerator accelerating said electrons such as to collide with said neutral particles.

23. Apparatus according to claim 22, wherein:

said accelerator comprises a pair of plates generating an electrical field.

24. Apparatus according to claim 21, wherein:

said source of electrons is supported for movement.

25. Apparatus according to claim 24, wherein:

said source of electron comprises a filament, said filament mounted on a moveable table and a motor and gearing is coupled to said table to selectively position said filament.

26. Apparatus according to claim 22, wherein :

said accelerator comprises a magnetic field generator forming a magnetic field which is superimposed on said electric field.

27. Apparatus according to claim 23, and further including first and second plates generating a second electric field, said plates position such that said second electric fields deflects said electrons.

28. Apparatus according to claim 21, and further including a lens electrode through which said electrons pas.

29. Apparatus according to claim 21, wherein :

said first converter includes a plate having an ion detecting part said plate having a positive high voltage applied thereto;

said second converter includes an electron flow generating unit for generating an electron flow for ionization having a mesh electrode facing opposite the collision surface of said ions on said plate, with a negative voltage applied behind said mesh electrode; and said detector comprises an ion amplifier in the rear stage of said electron flow generating unit.

30. Apparatus according to claim 29 wherein:

said plate is formed of a plurality of materials, and said negative ions are selectively collided against any one of said plurality of materials.

* * * * *

UNITED STATES PATENT AND TRADEMARK OFFICE

CERTIFICATE OF CORRECTION

PATENT NO. : 5,481,108

DATED : 2 January 1996

INVENTOR(S) : Masayoshi YANO et al.

It is certified that error appears in the above-identified patent and that said Letters Patent is hereby corrected as shown below:

| Column | Line | |
|---|---|---|
| 1 | 11 | Change "In general" to --Generally--. |
| 1 | 24 | Change "comparing" to --compared--. |
| 2 | 31 | After "then" insert --is--. |
| 2 | 50 | Change "ions" to --ion--. |
| 2 | 52 | Delete "being". |
| 2 | 55 | Change "electing" to --selecting--. |
| 2 | 61 | Change "in accompanying" to --together--. |
| 3 | 2 | After "lose" change "the" to --their--. |
| 3 | 16 | Change "to" (first occurrence) to --and--. |
| 3 | 47 | Change "called as" to --known as--. |
| 4 | 2 | Change "yielded" to --yield an--; change "comparing" to --compared--. |

UNITED STATES PATENT AND TRADEMARK OFFICE

CERTIFICATE OF CORRECTION

PATENT NO. : 5,481,108

DATED : 2 January 1996

INVENTOR(S) : Masayoshi YANO et al.

It is certified that error appears in the above-identified patent and that said Letters Patent is hereby corrected as shown below:

| Column | Line | |
|---|---|---|
| 4 | 3 | After "particles" insert --and--. |
| 4 | 8 | Change "spattered" to --sputtered--. |
| 4 | 27 | Change "on" to --of--. |
| 4 | 28 | Change "on" to --of--. |
| 4 | 29 | After "dealt" insert --with--. |
| 4 | 45 | Change "sandwiching" to --sandwich--. |
| 5 | 1 | Change "in beam" to --ion beam--. |
| 5 | 26 | After "dynode" insert --of--. |
| 8 | 3 | Change "position" to --positioned--; change "fields" to --field--. |

UNITED STATES PATENT AND TRADEMARK OFFICE

CERTIFICATE OF CORRECTION

PATENT NO. : 5,481,108

DATED : 2 January 1996

INVENTOR(S) : Masayoshi YANO et al.

It is certified that error appears in the above-identified patent and that said Letters Patent is hereby corrected as shown below:

| Column | Line | |
|---|---|---|
| 8 | 7 | Change "pas" to --pass--. |

Signed and Sealed this

Twenty-eighth Day of May, 1996

*Attest:*

*Attesting Officer*

BRUCE LEHMAN

*Commissioner of Patents and Trademarks*